US010352563B2

(12) United States Patent
Lam

(10) Patent No.: US 10,352,563 B2
(45) Date of Patent: Jul. 16, 2019

(54) FLAME DETECTOR WITH SIGNAL COLLECTOR AND FOCUSER

(71) Applicant: Detectors, Inc., Placentia, CA (US)

(72) Inventor: Adam Lam, Placentia, CA (US)

(73) Assignee: Detectors, Inc., Placentia, CA (US)

( * ) Notice: Subject to any disclaimer, the term of this patent is extended or adjusted under 35 U.S.C. 154(b) by 0 days.

(21) Appl. No.: 16/118,195

(22) Filed: Aug. 30, 2018

(65) Prior Publication Data

US 2019/0063746 A1 Feb. 28, 2019

Related U.S. Application Data

(60) Provisional application No. 62/552,478, filed on Aug. 31, 2017.

(51) Int. Cl.
*G08B 17/12* (2006.01)
*F23N 5/08* (2006.01)

(52) U.S. Cl.
CPC ..... *F23N 5/082* (2013.01); *F23N 2023/04* (2013.01); *F23N 2023/08* (2013.01); *F23N 2029/16* (2013.01)

(58) Field of Classification Search
CPC .. F23N 5/082; F23N 2023/04; F23N 2023/08; F23N 2029/00; F23N 2029/16; G08B 17/12; G08B 17/005; G08B 5/36
USPC ..... 340/577, 578, 506, 539.23; 250/372
See application file for complete search history.

(56) References Cited

U.S. PATENT DOCUMENTS

| | | | | |
|---|---|---|---|---|
| 7,541,938 | B1 * | 6/2009 | Engelhaupt | G08B 17/12 250/339.13 |
| 8,201,973 | B2 * | 6/2012 | Kudoh | G08B 29/08 362/253 |
| 8,346,500 | B2 | 1/2013 | Lee | |
| 8,445,857 | B2 * | 5/2013 | Sugino | F23N 5/082 250/372 |
| 9,062,850 | B2 * | 6/2015 | Mori | F21V 7/043 |
| 2005/0128093 | A1 * | 6/2005 | Genova | G08B 17/12 340/577 |

* cited by examiner

*Primary Examiner* — Ahn V La
(74) *Attorney, Agent, or Firm* — Jafari Law Group, Inc.

(57) ABSTRACT

The present invention concerns a flame detector with optical sensors situated within a housing, which is coupled to a signal collector and focuser enclosure. The enclosure includes a reflective surface or reflective surfaces generally oriented outwardly and in optical communication with the sensors through a shield window exposing the sensors; the shield window is situated between the enclosure and the housing of the flame detector. The enclosure may have a conical shape, a parabolic shape, and may include convex or concave surfaces that reflect emission signals from an emission signal source to the sensors in optical communication with the reflective surfaces. The enclosure is thus adapted to collect emission signals and narrow or focus a field of view of the sensors, thereby increasing a detection range between the flame detector and an emission signal source such as a flame source.

18 Claims, 10 Drawing Sheets

FLAME DETECTOR WITH SIGNAL COLLECTOR AND FOCUSER

PRIORITY NOTICE

The present application claims priority under 35 U.S.C. § 119 to U.S. Provisional Application 62/552,478, filed Aug. 31, 2017, the disclosure of which is incorporated herein by reference in its entirety.

TECHNICAL FIELD OF THE INVENTION

The present invention is generally directed to flame detectors, and more specifically, to a flame detector with a signal collector and focuser that improves flame detection by, amongst other improvements, focusing a field of view of the flame detector and increasing a detection range between the flame detector and a flame source.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Optical flame detectors are old in the art of providing automatic detection of fires. A feature shared by all such optical detectors is a shield window so that dust, soot or oil cannot be directly deposited on the optical detectors. Optical detectors are known to provide broad or narrow frequency detection of infrared and/or ultraviolet range frequencies. For instance, a typical hydrocarbon fire will typically have detectable peaks in the wavelengths of 2.7 and 4.3 micrometers. Ultraviolet radiation, though typically emitted at low levels, is detectable by way of on optical detector for an appropriate frequency range.

A flame detector, which is a type of fire detector having a fast detection response, is configured such that the light receiving element of the flame detector detects the specific wavelength bands of ultraviolet (UV) rays and infrared (IR) rays radiated from a flame, generated when a fire first originates, and detects the generation of the flame at the start of a fire using electronic characteristics that light energy is converted into electrical energy. Prior art flame detectors cannot cope with a deterioration in sensitivity when a monitoring window is covered with dust or the like, thus resulting in flames not being detected. While the prior art includes measurement of such deterioration of sensitivity based upon electronic detection and measurement of a later covered shield window as compared with a clean shield window, once a signal strength is reduced to below a minimum level required for detection of flames by the IR or UV sensors, due to fouling of the shield window or presence of smoke associated with the fire, no amount of signal compensation in the prior art flame detector systems will matter. The flames simply will not be detected.

U.S. Pat. No. 8,346,500 describes a common structural requirement and limitation of prior art flame detectors, i.e., in FIG. 6 is shown a sensing angle of sensors. That sensing angle is a simple consequence of requiring a housing and shield window above the support board for the IR and UV detectors. IR and UV signals passing through that sensing angle are not in the prior art captured or focused in any enhanced manner other than having the signal waves impinge upon the shield window and be transmitted through it to the IR or UV detectors below the shield window.

Such a structure is a limitation because signal waves that impinge upon the housing adjacent to or beyond the shield window are simply reflected into space and are unavailable to the sensors, where if such reflected signals were capable of being delivered to the sensors with the signals presently in the prior art sensing angles of flame detectors, a greater range of signals weakened by smoke, other physical obstacles, or fouling of the shield window would then result in positive detection of flames. The prior art has failed to provide a structure or method by which the range of detection of existing IR or UV sensors can detect flames because of the above described physical occlusion, small size of the flames, or a substantial distance between the flame and the flame detector, all situations in which IR or UV signals reaching the sensors can fall below detectable levels.

Optical sensors convert incoming IR and/or UV radiation into electrical signals, which are then preferably converted to digital signals for evaluation by comparison and alarm microprocessors to determine whether fire or flame is present in the space that can be detected by the sensors. It is well known that weak signals reaching the sensors result in a low signal to noise ratio so that a level of undetectability is reached. If that signal to noise ratio could be increased, the flame detectors' performance would improve in two ways: stronger signaling from flames could result in detection of flames and the flame detector would be much more immune to false alarms. The conventional method of increasing signal to noise ratio for incoming optical signals to optical sensors is to attempt improvement in sensor technology and/or signal processing for signals within a noisy environment. The current state of the art in flame detectors is directed solely at these two efforts to improve performance of flame detectors.

Even so, there is a need for provide a structure or method by which the range of detection of existing IR or UV sensors can detect flames because of the above described physical occlusion, small size of the flames, or a substantial distance between the flame and the flame detector, all situations in which IR or UV signals reaching the sensors can fall below detectable levels.

It is to these ends that the present invention has been developed.

SUMMARY OF THE INVENTION

To minimize the limitations in the prior art, and to minimize other limitations that will be apparent upon reading and understanding the present specification, the present invention describes a flame detector with a signal collector and focuser that improves flame detection.

Generally, the present invention concerns a flame detector with optical sensors situated within a housing that is coupled to a signal collector and focuser enclosure. The enclosure includes a reflective surface or reflective surfaces oriented outwardly and in optical communication with the sensors through a shield window exposing the sensors; the shield window is situated between the enclosure and the housing of the flame detector. The enclosure may have a conical shape, a parabolic shape, and may include convex or concave surfaces that reflect emission signals from a flame source to the sensors in optical communication with the reflective surfaces. The enclosure is thus adapted to collect emission signals and narrow or focus a field of view of the sensors thereby increasing a detection range between the flame detector and a flame source. The reflecting surfaces are preferably of a surface composition which easily reflect to a maximum level IR or UV signals that impinge upon them.

The structure and orientation of the reflecting surfaces are of multiple forms, but all forms result in collection of wave signals or emission signals to a greater degree than without the reflecting surfaces. In exemplary embodiments, at least a first portion of all emission signals collected by the one or more optical sensors are received indirectly from the flame source via the reflecting surfaces through a shield window, and at least a second portion of all emission signals collected by the one or more optical sensors are received directly from the flame source through the shield window. The effect of the reflecting surfaces in combination with the shield window provides a "magnifying lens" effect, so that more IR and/or UV waves may be captured and directed to and thus detected by the plurality of optical sensors. In the case of the invention, the detector is not a human eye appreciating a magnified object because of a lens system. Instead, the sensors receive more collected emission signals from the space in front of the shield window and can thereby detect flames that in the prior art would not be detectable due to physical occlusion of the shield window, smoke, or other physical objects, small size of the flames, a substantial distance between the flame and the flame detector, or other such obstructions or difficulties.

In exemplary embodiments, the present invention dramatically increases the detection capabilities of existing prior art flame detectors, so much so that the present invention can provide a retrofit reflecting surface to an existing flame detector and dramatically improve its performance in detection of flames. As such, in accordance with some exemplary embodiments of the resent invention, a housing or structure incorporating the reflecting surfaces may be easily attached to prior art flame detectors to achieve objectives of the present invention such as improving detection capabilities.

Digital signal processing of sensed IR or UV signals from the sensors is quite complex but well known in the art of flame detectors. It is known that such digital signal processing provides for summation of many weak signals received at the IR or UV sensors and its interpretation in flame detection alarming as if a single, larger IR or UV signal had directly impinged upon the shield window and then sensed at the sensors. The present invention provides for delivery of a larger cascade of weak, reflected emission signals from the reflected surfaces through to the sensors along with emission signals directly passing through the shield window to the sensors, the summation of which provides a summed signal so that the signal to noise ratio of the summed signal is within the pre-determined range indicating flames are present in a space in front of the flame detector. Reflected signals from the reflected surfaces, which are optionally compensated for by removal of noise caused by shield window fouling, increase the summed signal strength from the sensors with a noise level constant as compared with a prior art flame detector. It is posited that reflection of emission signals from some embodiments of the reflected surfaces reduce the signal to noise ratio for the entire reflected radiation from the reflected surfaces, resulting in improved signal to noise ratio of signals received at the sensors.

In some exemplary embodiments of the invention, multiple sensors in a flame detector receive IR or UV emission signals, which are separately processed by a detection microprocessor. A portion of all reflected signals from a portion of the reflection surfaces are detected by less than all the sensors so that differences in signals received by the detecting sensors may be utilized by a location algorithm to determine a location of the source of the received radiation, such as a flame source. That is, in exemplary embodiments, a location algorithm infers from the path of reflection of that portion of all reflected signals, a remote location of the source of the signals, i.e., a physical location of the flames from which the signals originated.

In some exemplary embodiments, a user may be presented with an output in a visible screen, by way of a local user interface, or via a client device in communication with the flame detector, or via client device in communication with a server having access to the output generated by the flame detector. In some exemplary embodiments, the output includes information generated by execution of the location algorithm showing an approximate location of detected flames in the space in front of the flame detector.

A flame detector, in accordance with exemplary embodiments of the present invention, may include: a sealed housing with a shield window incorporated on a top side of the sealed housing; a sensing circuitry disposed within an internal space of the sealed housing, the sensing circuitry including one or more optical sensors directed up toward the shield window; and a reflective surface coupled to the sealed housing arranged about a space outwardly from the shield window and adapted to reflect emission signals from an emission signal source to the one or more optical sensors, wherein the sensing circuitry is configured to determine if a flame is present in a field of view outside of the shield window.

A flame detector, in accordance with some exemplary embodiments of the present invention, may include: a sealed housing with a shield window incorporated on a top side of the sealed housing; a sensing circuitry disposed within an internal space of the sealed housing, the sensing circuitry including one or more optical sensors directed up toward the shield window; and a reflective surface coupled to the sealed housing arranged about a space outwardly from the shield window and adapted to reflect emission signals from an emission signal source to the one or more optical sensors, wherein the sensing circuitry is configured to: receive, from the one or more optical sensors, a set of signals associated with direct emission signals from the emission signal source; receive, from the one or more optical sensors, a set of signals associated with the reflected emission signals from the emission signal source that have been reflected by the reflective surface to the one or more optical sensors; and generate a user detectable signal in response to determining that a flame is present in a field of view outside of the shield window.

A method, in accordance with practice of some exemplary embodiments of the present invention, may include a method performed by a microprocessor that is disposed on a sensing circuitry of a flame detector. Such method, may include the steps of: receiving, from one or more sensors in optical communication with a parabolic or conical reflective surface coupled to a sealed housing securing the sensing circuitry, a first set of signals associated with direct emission signals received by the one or more sensors directly from an emission signal source; receiving, from the one or more sensors, a second set of signals associated with reflected emission signals from the emission signal source that have been reflected by the parabolic or conical reflective surface to the one or more sensors; and generating a user detectable signal in response to determining that a flame is present in a field of view outside of a shield window incorporated on a top side of the sealed housing.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF THE DRAWINGS

Elements in the figures have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. The drawings that accompany the detailed description can be briefly described as follows.

DETAILED DESCRIPTION OF THE DRAWINGS

Figure 1A:
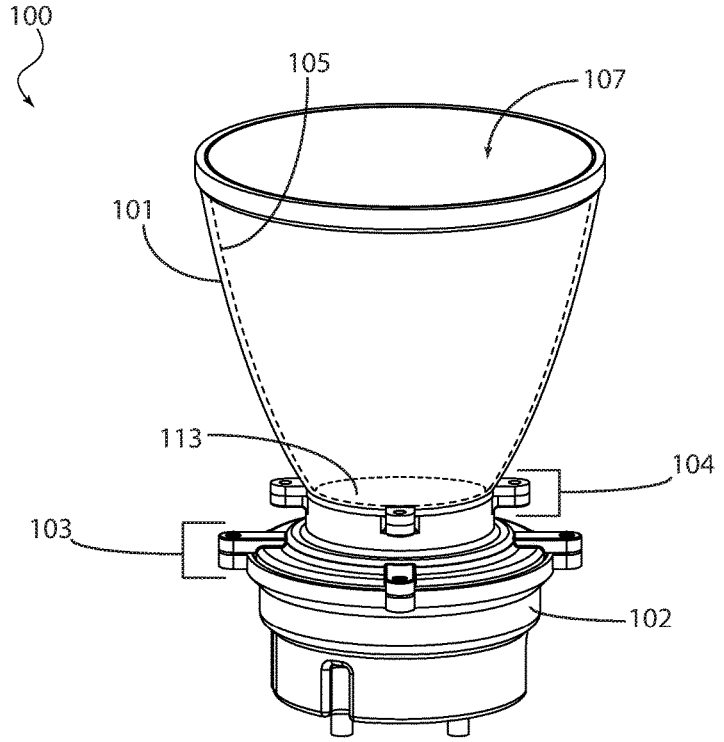
FIG. 1A illustrates a perspective view of a flame detector in accordance with an exemplary embodiment of the present invention.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy. Similarly, terms, such as "a, an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

The present disclosure relates to, among other things, to flame detectors with a signal collector and focuser that improves flame detection by increasing a detection distance to a flame source. Exemplary embodiments of the present disclosure are described with reference to the drawings for illustration purposes and are not intended to limit the scope of the present disclosure.

Figure 1B:
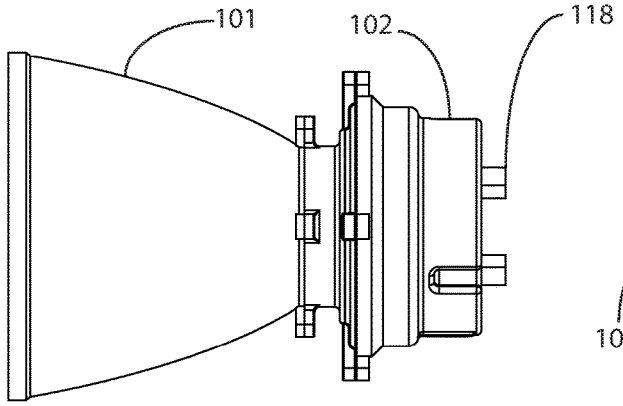
FIG. 1B illustrates a side view of a flame detector in accordance with an exemplary embodiment of the present invention.
Figure 1C:
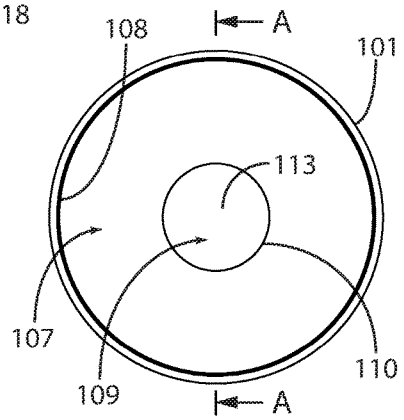
FIG. 1C illustrates a top view of a flame detector in accordance with an exemplary embodiment of the present invention.
Figure 1D:
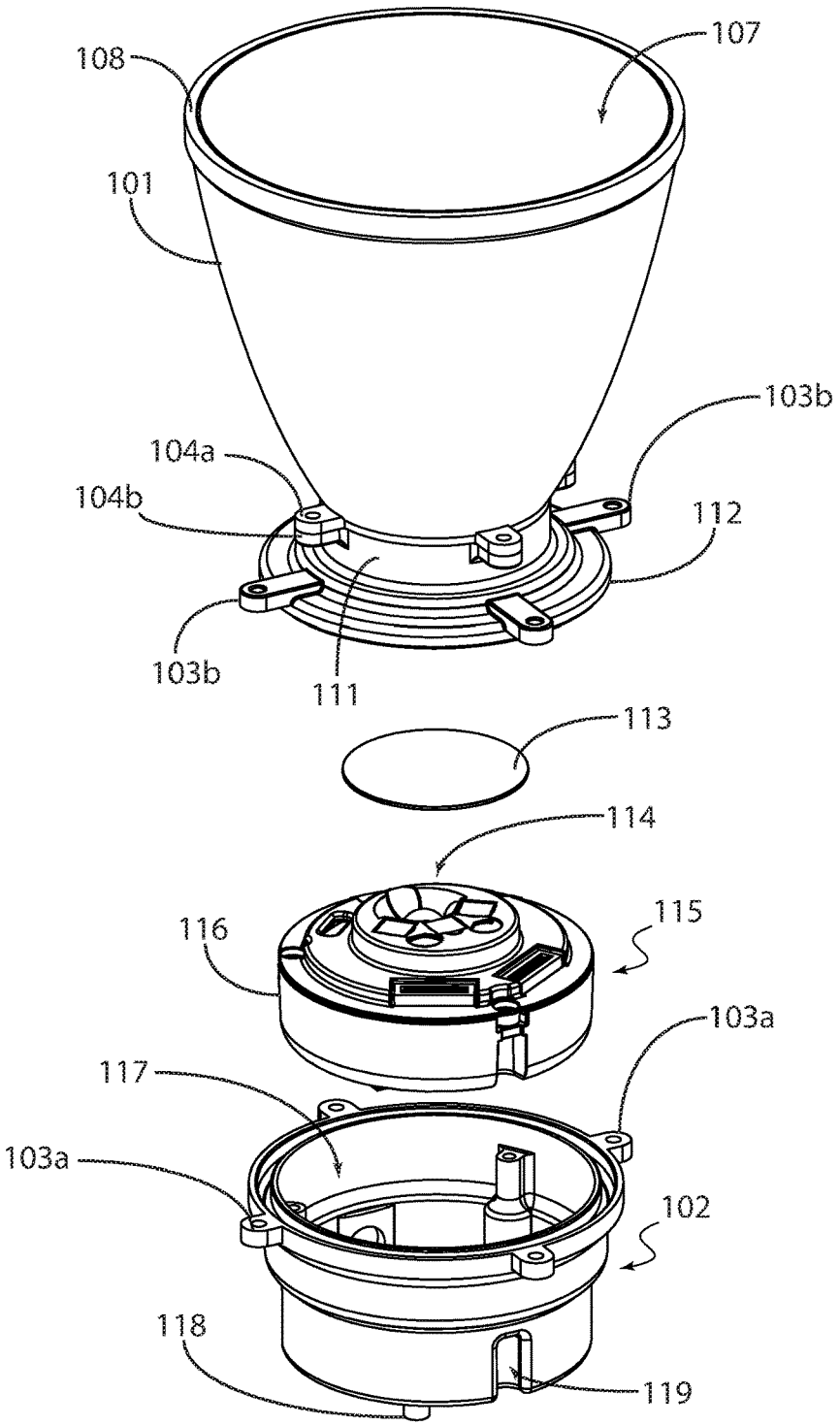
FIG. 1D illustrates an exploded view of a flame detector in accordance with an exemplary embodiment of the present invention.
Figure 1E:
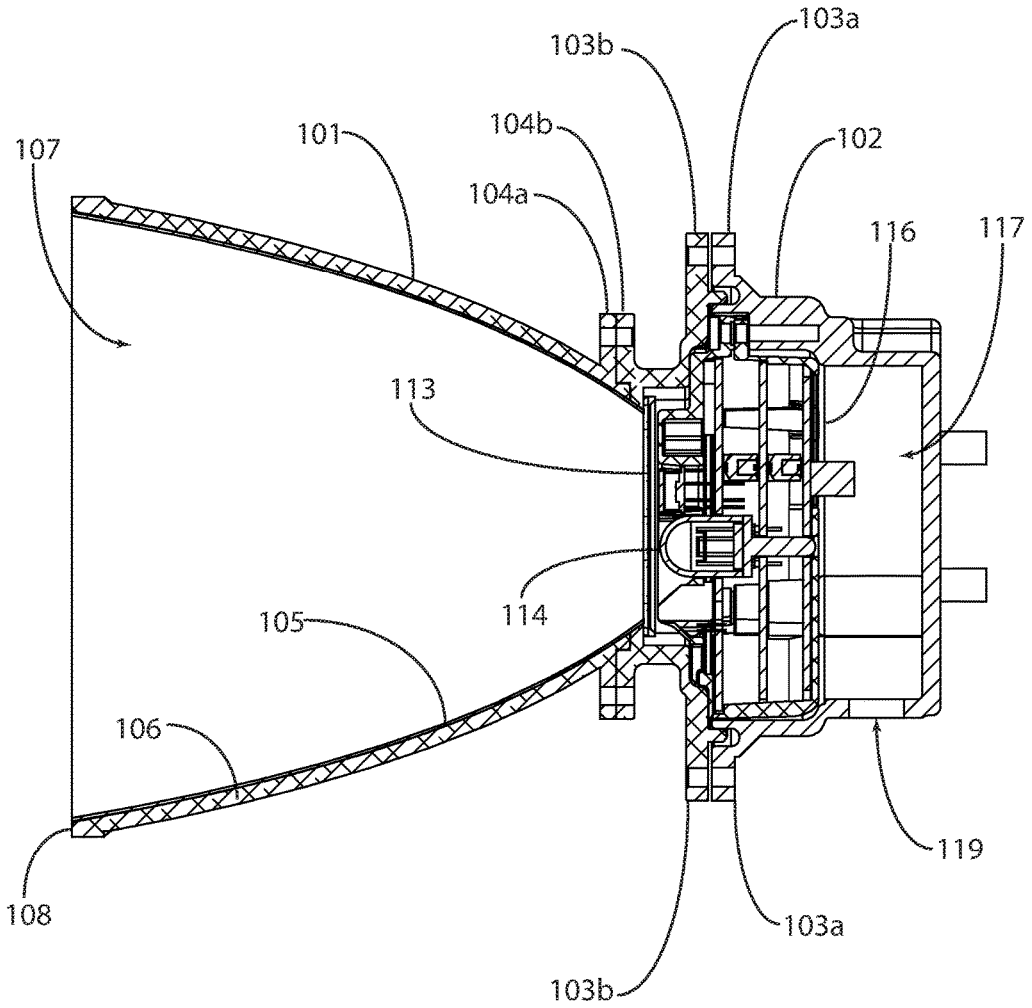
FIG. 1E illustrates a cross-sectional view of a flame detector in accordance with an exemplary embodiment of the present invention.

Turning now to the first set figures, FIG. 1A illustrates a perspective view of a flame detector in accordance with an exemplary embodiment of the present invention; FIG. 1B illustrates a side view thereof; FIG. 1C illustrates a top view of the flame; FIG. 1D illustrates an exploded view of the flame detector; and FIG. 1E illustrates a cross-sectional view thereof.

More specifically, FIG. 1A depicts flame detector 100, which comprises an enclosure 101 that serves as a signal collector and focuser for one or more optical sensors 114 coupled to a sensing circuitry of a sensing module 115 disposed within a sealed housing 102. In exemplary embodiments, such as shown in this first set of views, enclosure 101 may be removably coupled to housing 102 via complementary coupling portions 103 and or complementary coupling portions 104 extending from or integral with the enclosure 101 and or housing 102. Any known coupling mechanism may be implemented without deviating from the scope of the present invention. For example, and without limiting the scope of the present invention, in some exemplary embodiments, the coupling portions of enclosure 101 and housing 102 may include complementary threaded portions so that enclosure 101 may be threaded on or screwed on to a portion of housing 102. In some exemplary embodiments, complimentary snap-on portions one each of the enclosure 101 and housing 102 may be implemented so that the two structures snap in place together. In some exemplary embodiments, protrusions including openings for receiving a fastener such as a screw or bolt therein may be employed to ensure a secure coupling between enclosure 101 and housing 102 of flame detector 100. In yet other exemplary embodiments, enclosure 101 is integral with housing 102.

In the shown embodiment, coupling portions 103 comprise of a base protrusion 103*a* of housing 102 that couples to a top protrusion 103*b* of housing 102, each protrusion 103*a* and 103*b* having complementary apertures for receiving a fastening means such as a screw. Similarly, in exemplary embodiments such as the one depicted in this first set of figures, enclosure 101 may include coupling portions 104 which comprise of a base protrusion 104*b* that couples to a top protrusion 104*a* of enclosure 101, each protrusion 104*a* and 104*b* having complementary apertures for receiving a fastening means such as a screw. This configuration may facilitate easily cleaning a shield window and or the sensors sealed therein. Moreover, because enclosure 101 may be removable, enclosure 101 may be implemented with some prior art flame detectors with relative ease.

As may be appreciated from the different views of flame detector 100, enclosure 101 may include a conical or parabolic shape having an inner set of reflective surfaces or reflective surface 105, which may be coated with gold, silver or other reflecting coating to enhance a reflective power of the reflecting surface therein. Reflective surface 105 may be generally flat and arcuate along a viewing angle of the one or more optical sensors 114, which are typically behind a shield window 113. Alternatively, reflective surface 105 may be flat and arcuate at a diameter greater or less than the viewing angle of the one or more optical sensors 114 (or the view angle of the shield window 113). As will be discussed further below with reference to other embodiments and figures, reflective surface 105 may comprise a surface concave relative to a conical or other viewing angle of the sensors, i.e., such as a donut shape or otherwise as described below. Reflective surface 105 may comprise a surface convex relative to a conical or other viewing angle of the sensors, i.e., such as when a parabolic cone is used (i.e. see FIG. 1A, for example). In some exemplary embodiments, the reflective surfaces or reflective surface 105 may include surfaces such as a shift parabola fixed at an opening of its truncated base about the shield window. In such arrangements, the invention may be physically aimed at an expected source of flame that will be desired to be detected, i.e., this form of the invention provides directional flame detection that increases the distance of detection from the flame detector to a flame source by reducing a view angle of detection.

Regardless of the shape of reflecting surface 105, a curvature of reflecting surface 105 is preferably designed so that all signals from an emitting flame source within the view angle of the optical sensors 114 shall in part reach the optical sensors 114 as discussed further below with references to, for example, FIG. 2A.

Typically, enclosure 101 comprises a substantially tubular structure with a generally circular or curved side wall 106 (see FIG. 1E). Side wall 106 extends between a top opening or aperture 107 and a bottom opening or aperture 109, which create a cavity within enclosure 101. Aperture 107 is defined in part by a top rim 108 with a first diameter, and aperture 109 is defined in part by a bottom rim 110 with a second diameter, wherein the second diameter of the bottom aperture 109 is typically smaller than the first diameter of the top aperture 107. Inside enclosure 101, inner reflective surface 105 expands outwardly from bottom aperture 109, which is configured to receive or couple with a shield window 113 that protects the one or more optical sensors 114 electrically coupled to a sensing circuitry housed in housing 102.

Different auxiliary structures may be implemented with enclosure 101. For example, and in no way limiting the scope of the present invention, structures such as threaded portions or fastening components may be employed around a circumference or perimeter of the enclosure 101, such as top protrusions 104*a*, which protrude or extend from an outer circumference at the bottom of the enclosure such as rim 110 to couple or register with mating or complimentary base protrusions 104*b*, which protrude or extend from an upper side wall 111 of cap 112 of housing 102. In some exemplary embodiments, cap 112 is integral with enclosure 101. In some exemplary embodiments (as presently shown), cap 112 may be removed from a bottom portion of enclosure 101 so as to easily expose shield window 113, which sits within aperture 110 between a cavity of enclosure 101 and sensing module 115.

Housing 102 securely houses sensing module 115, which includes sensing circuitry disposed on a support plate or support structure that may be itself housed within its own housing 116 for protecting the sensing circuitry. As will be appreciated by a person of ordinary skill in the art, the sensing circuitry may employ known methods, structures and hardware a such as, for example, a printed circuit board (PLC) coupled to one or more optical sensors 114 disposed over a top portion of the sensing module 115 such that the one or more optical sensors 114 are in optical communication with reflective surface 105 of the interior of enclosure 101 on an interior side of shield window 113. Housing 102 may include any suitable shape adapted to receive sensing module 115 or otherwise a sensing circuitry and sensor combination in accordance with the present invention. In the embodiment shown in this first set of figures, for example, housing 102 includes a tubular or cylindrical shape that securely registers with sensing module 115, allowing sensing module 115 to snuggly fit within a top portion of cavity 117 therein, wherein a lower portion of cavity 117 may be suitable for housing electric and or data cables and the like.

In exemplary embodiments, sensing module 115 includes a body 111 configured to register with a cavity 117 formed within housing 102 for securing sensing module 115 therein. A person of ordinary skill will appreciate that housing 102 may include other structures and components to facilitate the functions of flame detector 100, including for example a connector means 119 or cable port 119, which may facilitate routing power from an external power source to sensing module 115, transmission of sensing data that may be generated by the sensing circuitry in response to receiving emission signals from a flame source, and or user detectable signals that may be generated in response to the sensing data in order to, for example, sound an alarm, deactivate a fuel line (such as a propane or a natural gas line), or activate a fire suppression system.

Accordingly, in exemplary embodiments, flame detector 100 may comprise: a sealed housing 102 with a shield window 113 implemented or incorporated on a top side of the housing 102; a support surface located within an internal space of the sealed housing 102 whereupon a sensing circuitry is disposed including one or more optical sensors 114 (such as one or more infrared and or one or more ultraviolet sensors) directed up toward the shield window 113; and a reflecting surface 105 coupled to the sealed housing 102 arranged about a space (or cavity between aperture 107 and aperture 109) outwardly from the shield window 113 and adapted to reflect signals from a flame source to the optical sensors, wherein the sensing circuitry is configured to determining if a flame is present in a field of view outside of the shield window 113. In some exemplary embodiments, the sensing circuitry may be configured to generate user detectable signals that sound an alarm, deactivate a fuel line (such as a propane or a natural gas line), or activate a fire suppression system. In some exemplary embodiments, the sensing circuitry may be configured to implement a location algorithm to generate an output comprising of an approximate location of the flame source.

Figure 2A:
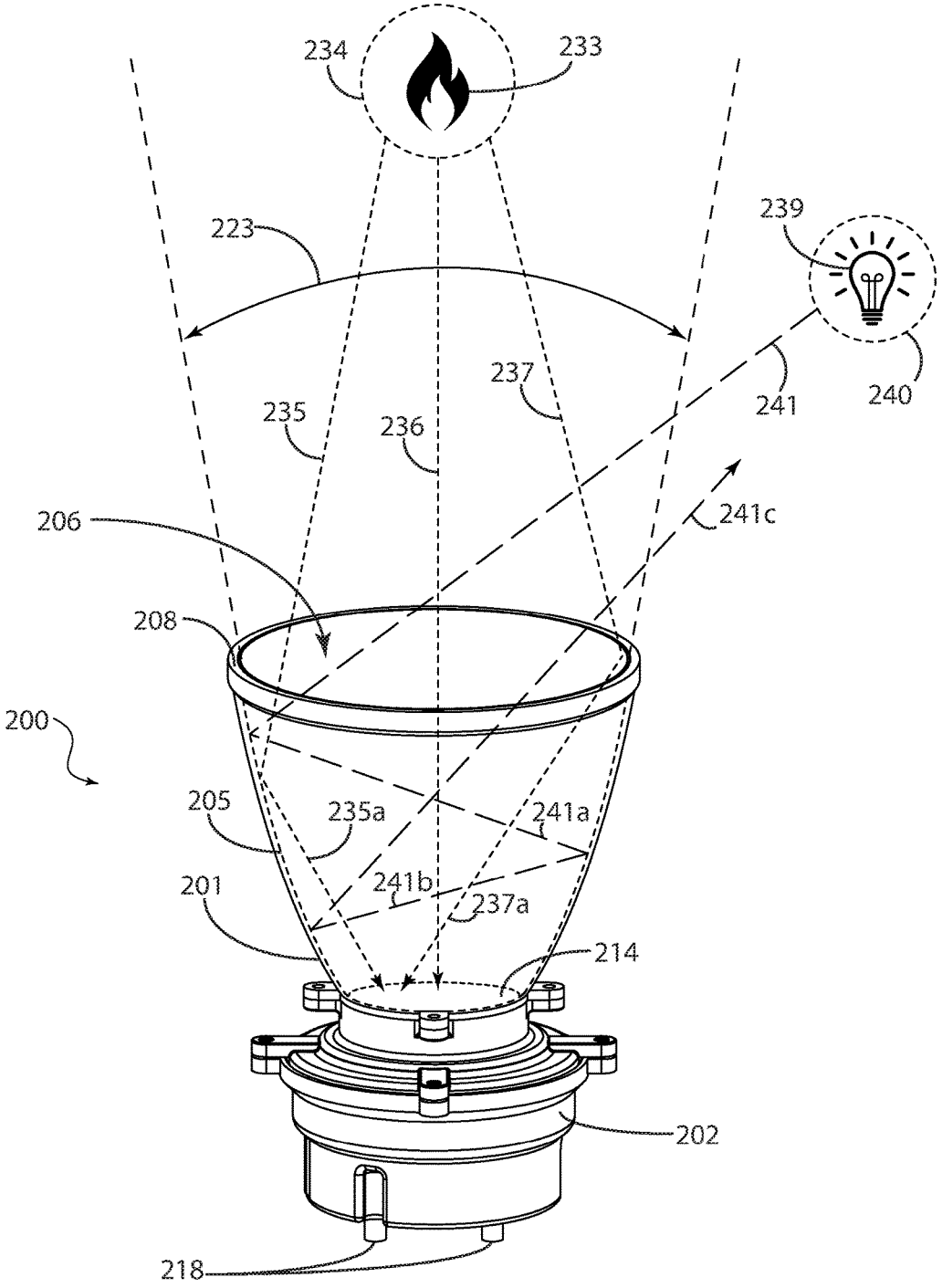
FIG. 2A illustrates a generalized diagram of how an exemplary embodiment of the present invention detects radiation from a flame source and avoids radiation from a source outside of a field of view of the detector.
Figure 2B:
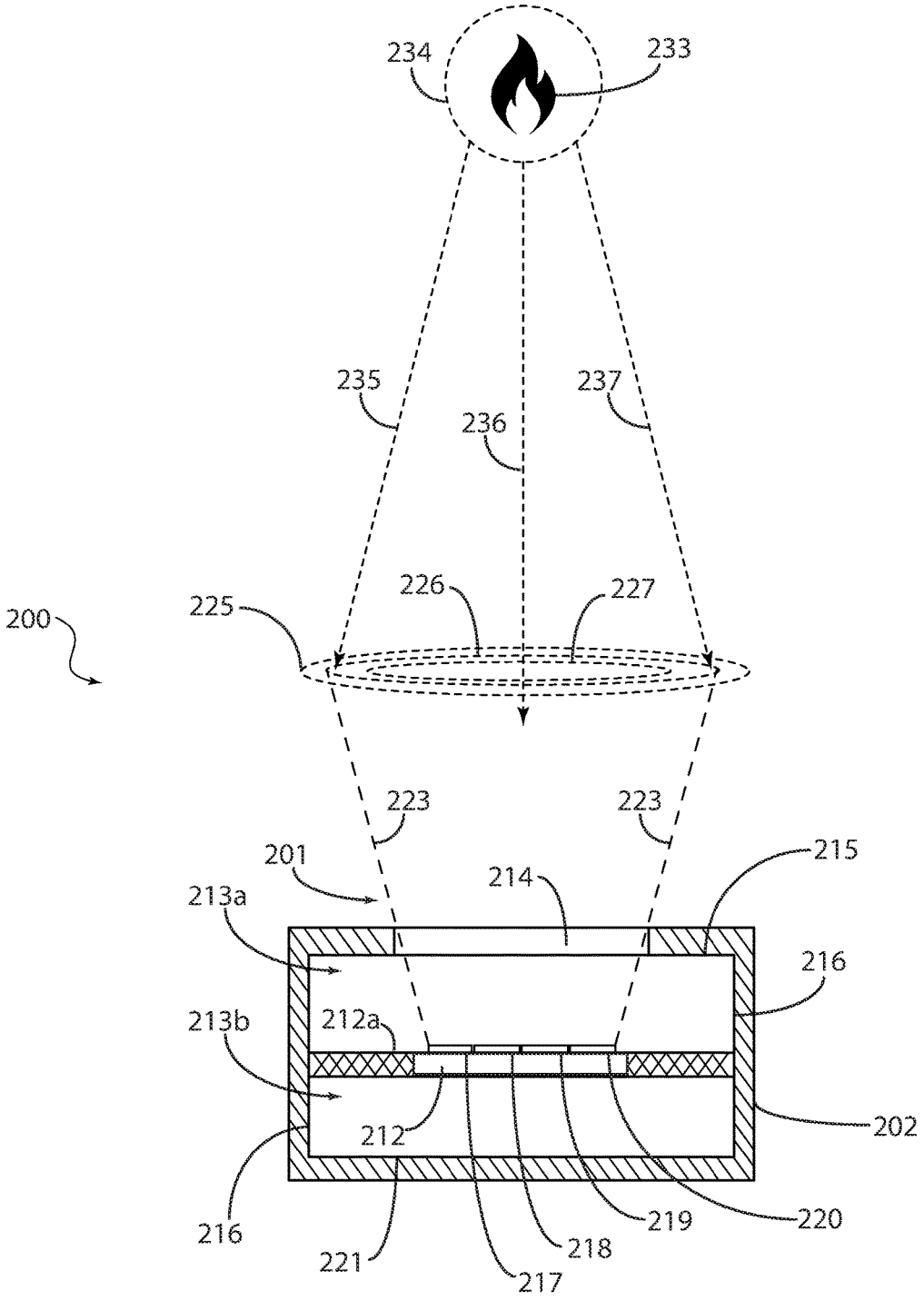
FIG. 2B illustrates another diagram, depicting a generalized side and cutaway view of a flame detector in accordance with the present invention.
Figure 2C:
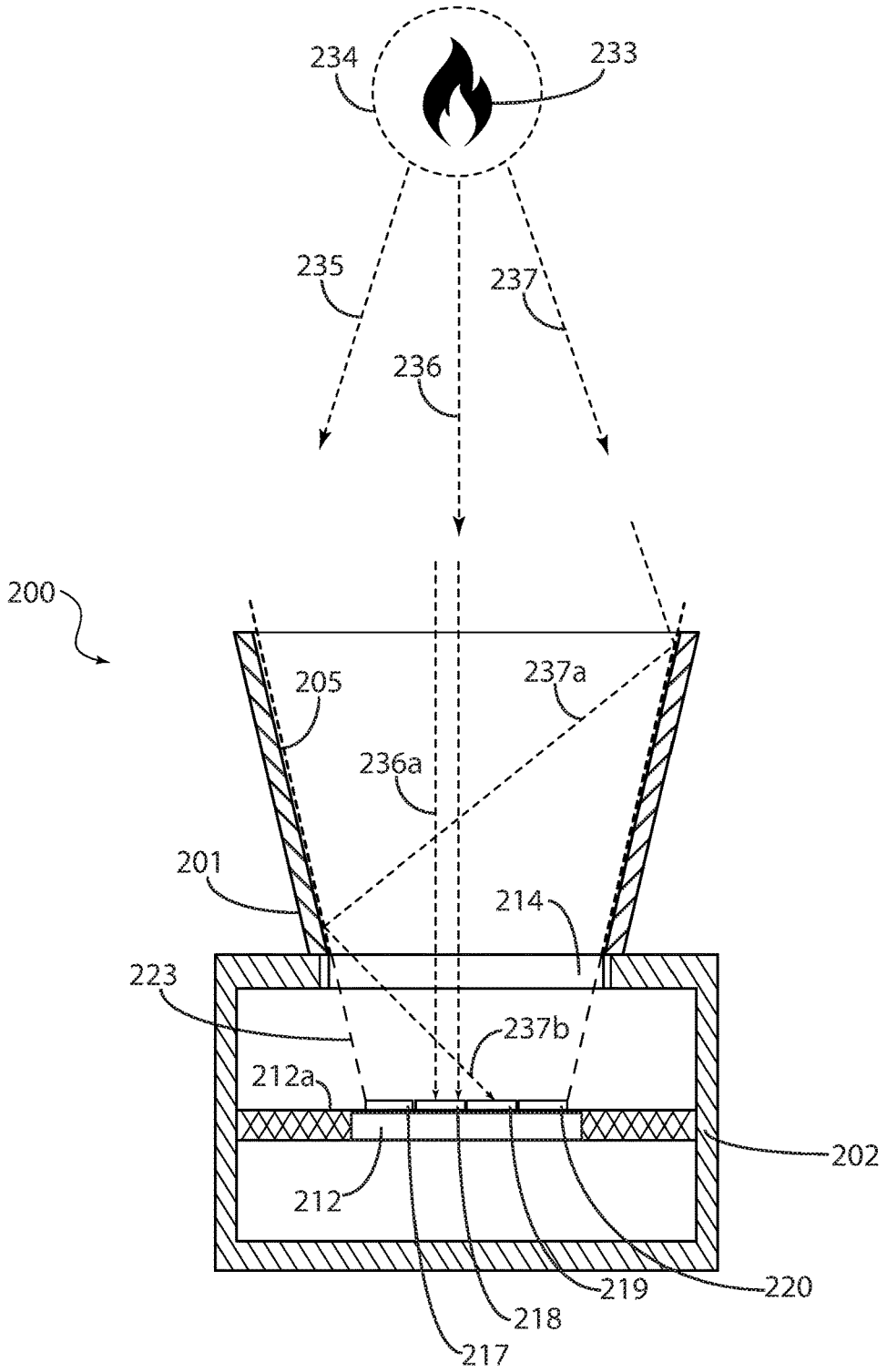
FIG. 2C illustrates another diagram, depicting the generalized side and cutaway view of a flame detector in accordance with the present invention, showing reflection of signals from a flame reflected on a conical reflecting surface and detected by a plurality of sensors.
Figure 2D:
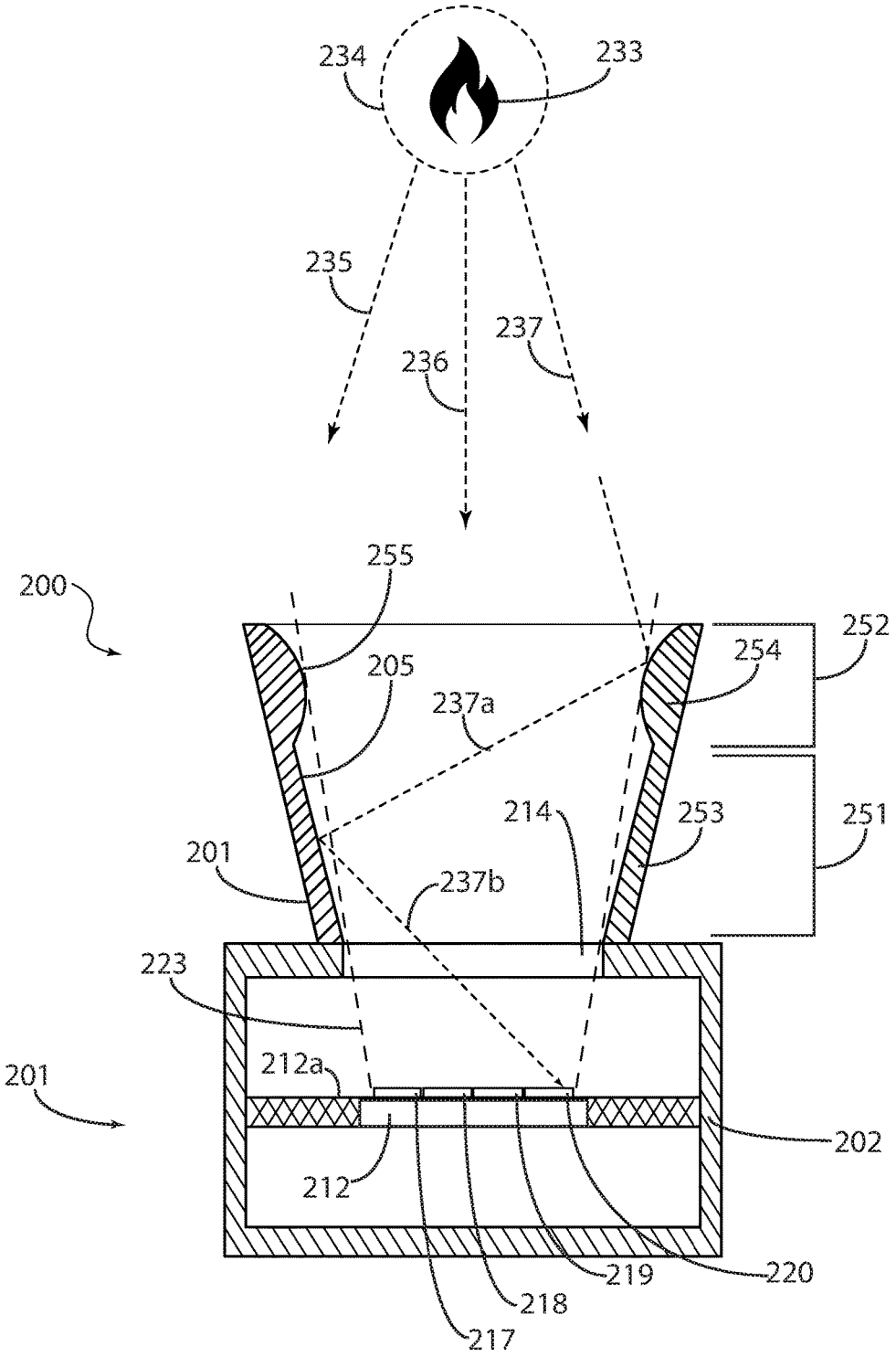
FIG. 2D illustrates another diagram, depicting the generalized side and cutaway view of a flame detector in accordance with the present invention, showing reflection of signals from a flame reflected on a concaved reflecting surface and detected by a plurality of sensors.

Turning now to the next set of figures, FIG. 2A illustrates a generalized diagram of how an exemplary embodiment of the present invention detects radiation from an emissions signal source such as a flame source and avoids radiation from a source outside of a field of view of the detector; FIG. 2B illustrates another diagram, depicting a generalized side and cutaway view of an exemplary embodiment of the flame detector in FIG. 2A; FIG. 2C illustrates another diagram showing reflection of signals from a flame reflected on a conical reflecting surface and detected by a plurality of sensors; and FIG. 2D illustrates another diagram, showing reflection of signals from a flame reflected on a concaved reflecting surface and detected by a plurality of sensors.

With reference to FIG. 2A, a generalized diagram is depicted of how an exemplary embodiment of the present invention detects radiation or emission signals from an emission signal source such as a flame source and avoids emission signals from a source outside of a field of view of the detector. More specifically, FIG. 2A illustrates a flame detector 200 that includes an emission signal collector and focuser (enclosure 201) comprising a reflecting surface 201 disposed within a cavity 206 of the enclosure 201, and a sensing circuitry disposed within a housing 202 for a lower part of the detector 200, upon which housing 202 is mounted the reflecting surface 205 disposed inside the enclosure 201. Electrical and data cords may be introduced into the housing 202 for connection with a detection microprocessor of the sensing circuitry for powering the detector 200 and for transmission of digital signals to and from detector 200.

As mentioned above, the shape of reflecting surface 205 may depend on the shape of enclosure 201. For example, and without limiting the scope of the present invention, reflective surface 205 may comprise a conical shape wherein enclosure 201 has a conical interior surface fixed at an open end portion about shield window 214 so that the reflective surface 205 is exposed to the space or cavity 206 beyond an opening defined by a top rim 208. In some exemplary embodiments, reflective surface 205 may comprise a parabolic shape wherein enclosure 201 has a parabolic or convex interior surface fixed at an open end portion about a shield window 214 so that the reflective surface 205 is exposed to the space or cavity 206 beyond an opening defined by a top rim 208. Yet, in other embodiments, an exterior shape of enclosure 201 may differ than an interior shape of the enclosure 201 such that enclosure 201 includes an exterior a first shape and reflective surface 205 includes a second shape different than the first shape.

Accordingly, reflective surface 205 may be flat and arcuate along a viewing angle of the flame detecting sensors (not shown) below shield window 214 or may be flat and arcuate at a diameter greater or less than the viewing angle of the flame detecting sensors. In some exemplary embodiments, reflective surface 205 may comprise a surface convex relative to a conical or other viewing angle of the sensors, i.e., such as when a parabolic cone is used. In some exemplary embodiments, reflective surface 205 may comprise a surface concave relative to a conical or other viewing angle of the sensors, i.e., such as a donut shape or otherwise as described below (see for example FIG. 2D).

In exemplary embodiments, whether conical or parabolic in shape, inner reflective surface 205 of enclosure 201 is preferably coated with gold, silver or other reflecting coating to enhance reflective power of the reflecting surfaces 205. The reflecting surface or surfaces 205 are preferably of a surface composition which easily reflect to a maximum level IR or UV signals that impinge upon them.

For illustrative purposes, FIG. 2A shows an emissions source or flame source 233 with a typical emission of energy or radiation represented by a gray body 234 in broken lines. Gray body 234 emits a broad range of radiation wavelengths or emission signals 235, 236, and 237 typical of an open flame. Some of those emission signals are of a first type in that they are transmitted directly to the sensing circuitry or optical sensors via a direct path and may be referred to as direct path or direct emission signals 236 transmitted directly through shield window 214 and detected by the one or more sensors of flame detector 200. Some of those emission signals are of a second type in that they are transmitted indirectly to the sensing circuitry or optical sensors via an indirect path that is reflected off of reflective surface 205 prior to being transmitted through shield window 214 and detected by the one or more sensors of flame detector 200. Such second type of emission signals that are first reflected by the reflective surface 205 may be referred to as reflected emission signals 235 and 237. For example, and in no way limiting the scope of the present invention, while a direct emission signal 236 travels in a direct path from grey body 234 to shield window 214, a reflected emission signal 235 travels first to a portion of reflective surface 205, then gets reflected to travel in reflected path 235*a* to shield window 214. Similarly, reflected emission signal 237 travels first to a portion of reflective surface 205, and then gets reflected to travel in reflected path 237*a* to and through shield window 214. As will be explained further below, because the one or more sensors of detector 200 collectively receive multiple emission signals, a sum of the receiving emission signal amplitude is increased (when compared to only receiving direct emission signals) allowing for an increased distance of detection within a narrow but more focused field of view angle 223 of the sensing circuitry.

Additionally, reflecting surface 205 reflects and rejects emission signals from sources that may be desirably ignored or left undetected by flame detector 200. This may be achieved by positioning flame detector 200 such that the field of view angle 223 excludes such desirably ignored sources of emission signals. That is, a critical feature of the invention, whereby desired open flames such as candles or lighters, or even other necessary sources of light that may be desirably used outside of the viewing angle 223 of the reflecting surface 205, is that flame detector 200 may be positioned to ignore these other sources of emission signals without fear of setting off an alarm or causing a detection of flame by flame detector 200 or merely interfering with an accuracy and or precision of flame detector 200. For illustrative purposes, and without limiting the scope of the present invention, FIG. 2A further shows a light source 239 with a typical emission of energy or radiation represented by a gray body 240 in broken lines, which may be for example emitting a desired light, for example in a tunnel. To avoid emission signals such as emission signals 241 from interfering in any way with flame detector 200, flame detector 200 may be, by design, placed at a certain distance and location such that the gray body 240 is outside the field of view 223 of flame detector 200. Accordingly, in exemplary embodiments, emission signals 241, which are preferably undetected so as not falsely set off or interfering with an accuracy and or precision of flame detector 200, will be avoided since emission signals 241 will follow a path 241*a* upon striking reflective surface 205, and be reflected via pathways 241*b* and finally 241*c* so as to bounce back outside of cavity 206 and away from the shield window 214. In this way, the one or more sensors of flame detector 200 avoids receiving emission signals 241 that may otherwise undesirably interfere with flame detector 200.

Now with reference to FIG. 2B, another diagram, depicting a generalized side and cutaway view of the flame detector in FIG. 2A is illustrated. FIG. 2B is a generalized side and cutaway view of the flame detector 200 of the invention, which as mentioned above comprises a sealed housing 202 with a shield window 214 arranged in coupled to or incorporated at an aperture situated at a top surface 215 of the housing 202, said shield window 214 generally controlling a sensor field of range of detection or the view angle 223 of the shield window 113 for IR or UV optical detector(s) 217, 218, 219, and 220, which are adapted to receive emission signals (such as emission signals 235, 236, and 237) from flame source 234, and transmit electrical signals in response to specific frequency ranges of light or emission signals transmitted through the shield window 214 from a likely flame location zone within the view angle 223.

As illustrated in FIG. 2B, the view angle 223 may be increased or decreased by changing the reflecting surfaces of the enclosure (or similar arrangement for different geometries of shield windows, such as square or oval) indicated in broken lines for a conical enclosure having a circumference 226 corresponding to view angle 223 or a greater viewing angle for a conical enclosure having a circumference 225 or a smaller viewing angle for a conical enclosure having a smaller circumference 227.

From the generalized cross-sectional view, it may be appreciated that housing 202 houses a sensor module, which may include a printed circuit board (PCB 212) disposed on a support plate or support structure 212*a* within housing 202. As such, generally a space 213*a* may be defined between PCB 212, top surface 215 and side walls 216 of the housing 202. Similarly, space 213*b* may be defined between PCB 212, a bottom plate 221 and side walls 216 of the housing 202.

Turning now to FIG. 2C, another diagram depicts the generalized side and cutaway view of the flame detector in FIG. 2A, showing reflection of signals from a flame reflected on a conical reflecting surface and detected by a plurality of sensors. More specifically, FIG. 2C shows flame detector 200 operating to detect a flame 233 through operation of optical sensors 217, 218, 219, and 220, which transmit signals to PCB 112. In exemplary embodiments, direct emission signals 236 may be directly transmitted to sensor 218 via direct paths such as direct path 236*a*. Reflected emission signals 237 may be reflected from reflective surface 205 to travel in a reflected path such as reflected path 237*a* and optionally reflected again to via reflected path 237*b* to pass though shield window 214 and be detected by sensor 219.

As mentioned above, optical sensors 217, 218, 219, and 220 may be of the types well known in the art and are selected according to a desired range of frequencies of light from a flame 233 desired to be detected elsewhere within the viewing angle 223 determined by the reflecting surfaces 205. In exemplary embodiments, shield window 214 may comprise optical properties to act as a filter to light transmitted to the shield window 214 to cooperate with optical sensors 17-20 to reduce the likelihood of a false alarm and to improve the likelihood of detection of an actual flame.

Turning now FIG. 2D, another diagram depicts the generalized side and cutaway view of the flame detector in FIG. 2A, showing reflection of signals from a flame reflected on a concaved reflecting surface and detected by a plurality of sensors. More specifically, FIG. 2D depicts an embodiment of detector 200 but with a concave reflective surface 255, which may form a donut shape ring in the interior region of enclosure 201. Accordingly, in this exemplary embodiment, reflective surface 205 comprises a first section 251, which may be a conical section with a slanting flat side wall 253, and a second section 252 comprising the concave surface 255 providing a concaved side wall 254 (i.e. having a semicircle diameter of semicircular shape, providing a "donut" reflector surface).

In exemplary embodiments, emission signals 237 may be reflected from reflective surface 255 to travel in a reflected path such as reflected path 237*a* and optionally reflected again via reflected path 237*b* to pass though shield window 214 and be detected by sensor 219. It has been found that the unique focusing of reflective emission signals 237 by contact with concave reflective surface 255 as result in a detected flame signal higher than fifty to one hundred percent or more increase over the same flame detected with the reflecting surfaces 205. signals 237*a* and 237*b*.

In general, flame detector 200 operates to (i) receive a set of direct emission signals 236 from an emission signal source 234 within a view angle 223 of a reflective surface 205 of the flame detector 200, (ii) receive a set of reflected emission signals 235, 237 from the emission signal source 234 that have been reflected by the reflective surface 205 in optical communication with one or more optical sensors 217, 218, 219, and 220 of the flame detector 200, (iii) generate a digital signal associated with the direct emission signals and the reflective emission signals, and (iv) activate user detectable signals, for instance, in the form of a local viewable light, a local audible alarm, a local display of an alarm notification on a user interface, and/or transmission of commands to produce those user detectable signals to a remote location for a remote correspondent user in communication with a microprocessor and associated circuits of flame detector 200, such as by way of Internet or wireless communication to a remote computer or handheld cellular telephone or similar mobile device.

Figure 5:
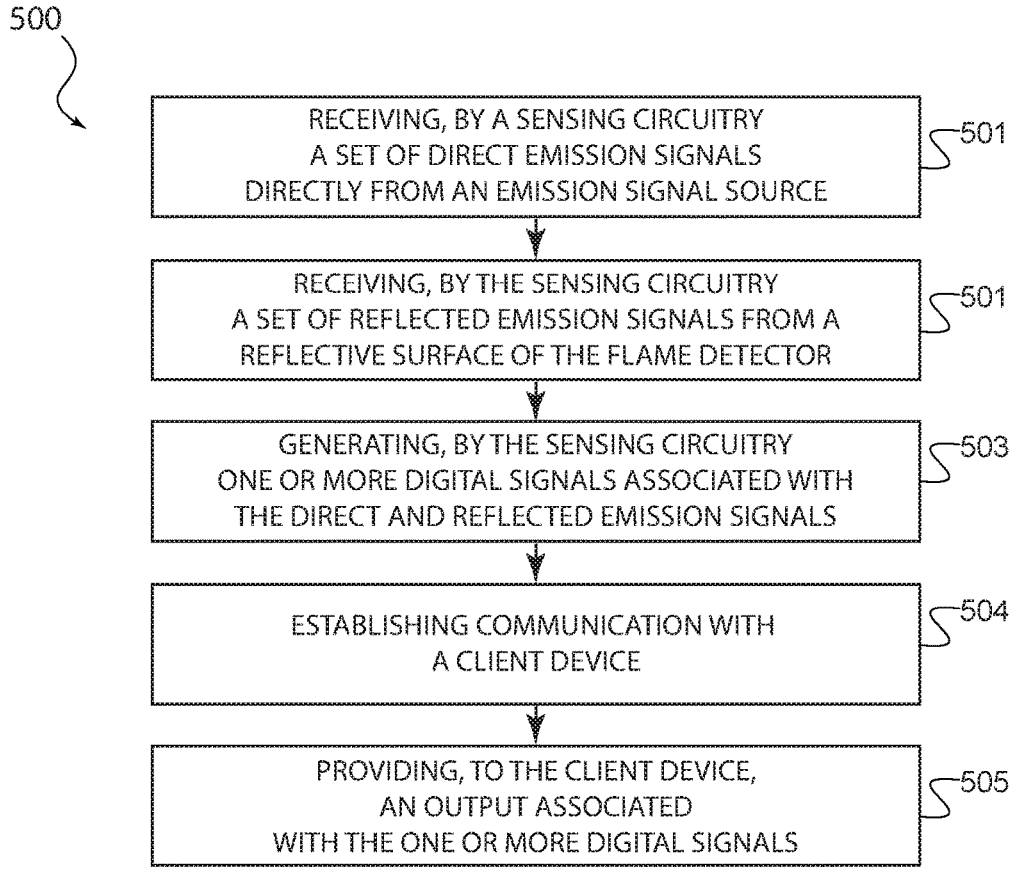
FIG. 5 illustrates a method implemented by a flame detector system in accordance with exemplary embodiments of the present invention.

In exemplary embodiments, PCB 112 is configured to receive the signals from the optical sensors and generate detectable signals, for instance, in the form of a viewable light, an audible alarm, a display of an alarm notification on a user interface, and/or transmission of commands to produce those user detectable signals to a remote location for a remote correspondent user in communication with a microprocessor and associated circuits of flame detector 200, such as by way of Internet or wireless communication to a remote computer or handheld cellular telephone or similar mobile device, as will be discussed further below with reference to FIG. 5. In exemplary embodiments, PCB 212 may be furthered configured to generate a cleaning signal indicative of a warning to clean the outside surface of shield window 214.

Figure 3A:
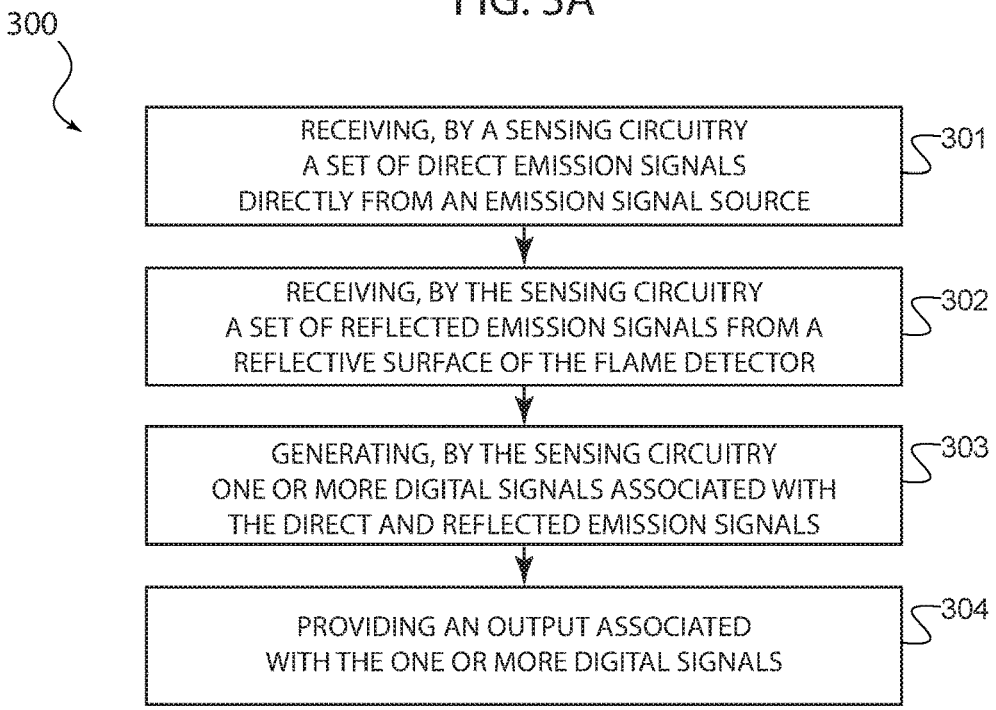
FIG. 3A illustrates a flow chart of an exemplary method implemented by a flame detector in accordance with exemplary embodiments of the present invention.

The next set of figures disclose exemplary methods performed by a flame detector in accordance with the present invention. Turning first to FIG. 3A, a flow chart of an exemplary method, implemented by a flame detector in accordance with exemplary embodiments of the present invention, is illustrated. More specifically, FIG. 3A depicts method 300 for generating a user detectable signal based on sensing a plurality of signals from a flame source. Although method 300 is exemplarily shown with a series of steps in one particular sequence, method 300 may include fewer or more steps in alternative sequences without deviating from the scope of the present invention.

Method 300 involves a flame detector with reflecting surfaces fixed at an opening of the detector's truncated base about a shield window exposing one or more optical sensors to the reflecting surfaces within a view angle. In this arrangement, the detector may be physically aimed at an expected source of flame that will be desirably detected, i.e., this form of the invention provides directional flame detection that increases the distance of detection between the flame detector to a flame source by reducing or focusing a view angle of detection. Curvature of the reflecting surfaces may be designed so that all signals from an emitting signal source (i.e. the flame) within the view angle shall in part reach the optical sensors. As described above, the sensors receive a first set of emission signals directly from the flame source and further receive a second set of emission signals from the flame source that are reflected on the reflecting surfaces prior to reaching the optical sensors.

Accordingly, in step 301, a set of direct emission signals from an emission signal source within a view angle of a reflective surface of the flame detector may be received by a sensing circuitry including one or more optical sensors of the flame detector. In step 302, a set of reflected emission signals from the emission signal source that have been reflected by the reflective surface in optical communication with the one or more optical sensors of the flame detector may be received. That is, the sensors receive a first set of signals directly from the flame source and a second set of signals from the flame source reflected on a reflecting surface that reflects the reflected signals to the sensors. In step 303, a digital signal associated with the direct emission signals and the reflective emission signals may be generated by a microprocessor coupled to the one or more optical sensors, wherein the digital signal may comprise one or more user detectable signals, for instance, in the form of a local viewable light, a local audible alarm, a local display of an alarm notification on a user interface, and/or transmission of commands to produce those user detectable signals to a remote location for a remote correspondent user in communication with a microprocessor and associated circuits of flame detector As mentioned above, such user selectable signal may include, without limiting the scope of the present invention, a local viewable light, a local audible alarm, a local display of an alarm notification on a user interface, and/or transmission of commands to produce those user detectable signals to a remote location for a remote correspondent user in communication with a microprocessor and associated circuits of the flame detector, such as by way of Internet or wireless communication to a remote computer or handheld cellular telephone or similar mobile device. Moreover, in step 304, an output associated with the user detectable signal may also be optionally provided—for example: a log recording the incident of sounding an alarm, deactivating a fuel line (such as a propane or a natural gas line), or activating a fire suppression system.

Figure 3B:
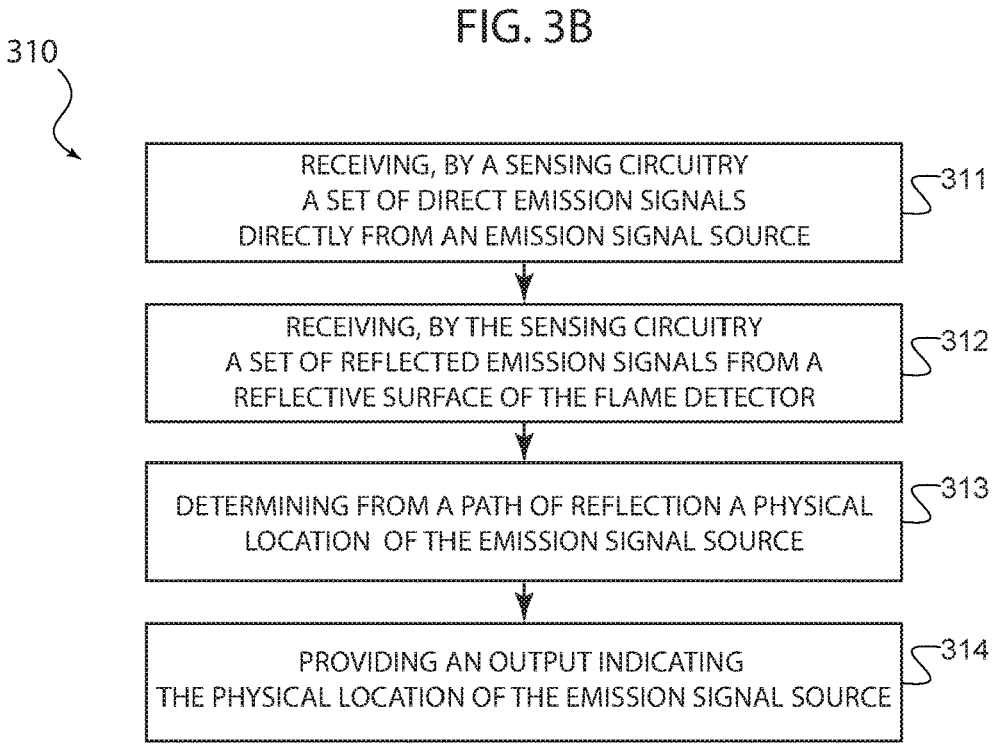
FIG. 3B illustrates a flow chart of another exemplary method implemented by a flame detector in accordance with exemplary embodiments of the present invention.

Turning now to FIG. 3B, a flow chart of another exemplary method, implemented by a flame detector in accordance with exemplary embodiments of the present invention, is illustrated. More specifically, FIG. 3B depicts method 310 for determining a location of a flame. Although method 310 is exemplarily shown with a series of steps in one particular sequence, method 310 may include fewer or more steps in alternative sequences without deviating from the scope of the present invention.

In another form of the invention, multiple sensors in the invention flame detector may receive IR or UV signals that are separately processed by a detection microprocessor. A portion of all reflected signals from a portion of the reflection surface may be detected by less than all the sensors so that differences in signals received by the detecting sensors result in computation by an algorithm of a location of the source of the radiation signals. The microprocessor, adapted to execute the location algorithm, is configured to infer from the path of reflection of that portion of all reflected signals a remote location of the source of the signals, i.e., a physical location of the flames from which the signals originated. Thus, the present invention allows the user to be presented with output in a visible screen or otherwise of information concerning an estimated location of detected flames in the space in front of the flame detector that were the origin of the portion of all reflected signals.

Accordingly, in step 311, a set of direct emission signals from an emission signal source within a view angle of a reflective surface of the flame detector may be received by a sensing circuitry including one or more optical sensors of the flame detector. In step 312, a set of reflected emission signals from the emission signal source that have been reflected by the reflective surface in optical communication with the one or more optical sensors of the flame detector may be received. That is, the sensors receive a first set of signals directly from the flame source and a second set of signals from the flame source reflected on a reflecting surface that reflects the reflected signals to the sensors. In step 313, a computation by an algorithm of a location of the source of the emission signals may be executed, wherein the algorithm infers from the path of reflection of that portion of all reflected emission signals a remote location of the source of the emission signals, i.e., a physical location of the flames from which the emission signals originated. In step 314, an output indicative of the physical location of the source of the signals may be provided. This may be achieved via a screen output or an output via a user interface on a remote device or a local user interface (UI) on the flame detector itself.

For example, and without limiting the scope of the present invention, the following figure discloses an exemplary flame detector system in which an output indicating the physical location of a flame source may be provided on a mobile device and or uploaded to a cloud service for remote access via a dedicated user interface.

Figure 4:
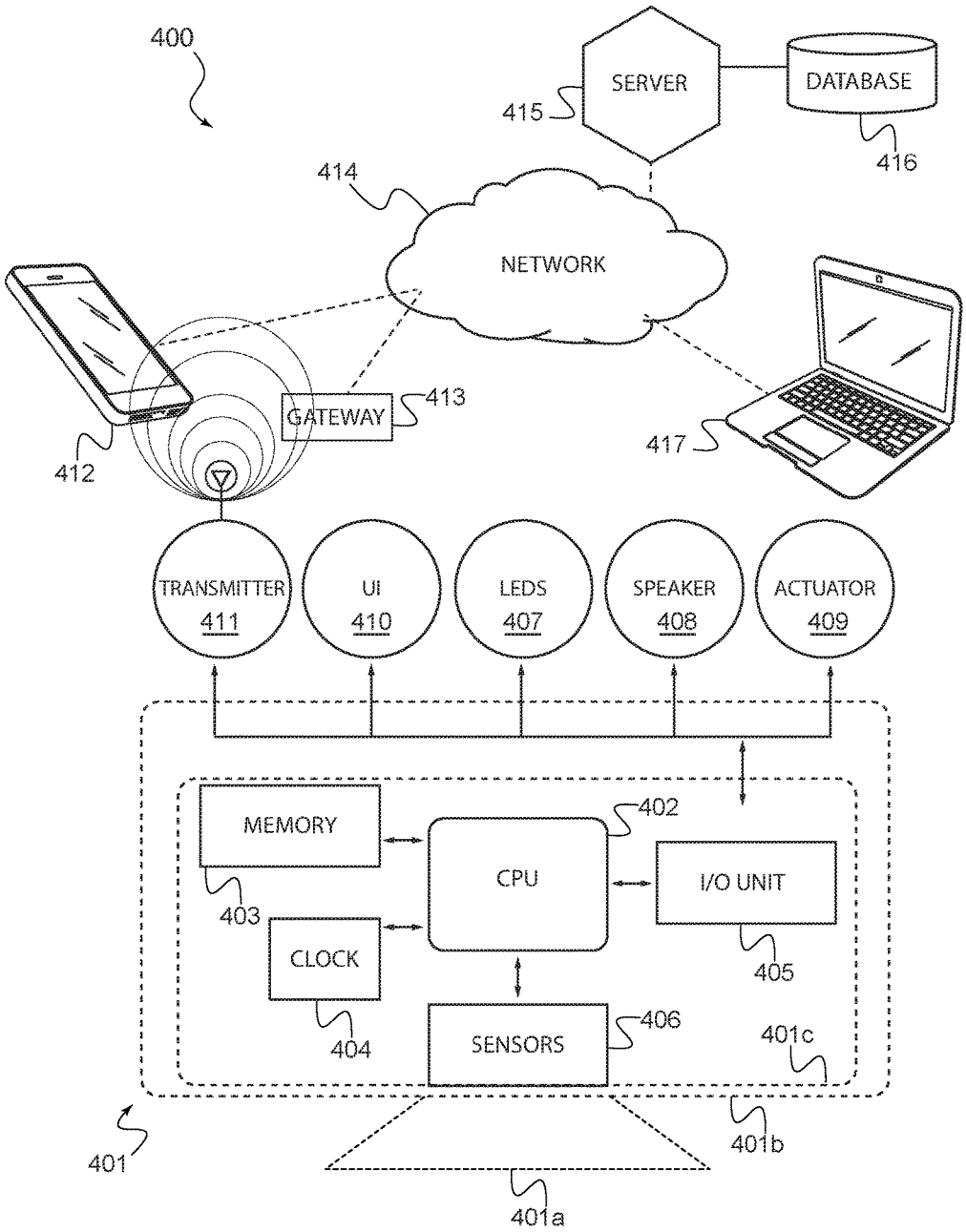
FIG. 4 illustrates a flame detector system in accordance with the present invention for providing output information determined from sensing data gathered by a flame detector.

Turning now to the next figure, FIG. 4 illustrates a flame detector system in accordance with the present invention for providing output information determined from sensing data gathered by a flame detector having the characteristics disclosed above. More specifically, FIG. 4 depicts system 400, which includes a flame detector 401 comprising a signal collector and focuser enclosure 401*a*, including a reflective surface inside the enclosure, and a housing 401*b* including a sensing module with a sensing circuitry 401*c* comprising: a microprocessor or CPU 402, a memory 403, a clock 404, which are directly or indirectly connected with an I/O unit 405, which comprises circuits, switches, converters, circuits and the like to accomplish the objects of the invention, and optical sensors 406 in optical communication with the reflective surface of the enclosure 401*a*, typically through a shield window as discussed above.

Optical sensors 406 detect and transmit to CPU 402 detected levels of light transmitted through the shield window of enclosure 401*a*. An executable control program or set of executable instructions stored in memory 403 operates to determine if user detectable signals should be activated, in accordance with the executable instructions programmed via known means.

Depending on the complexity of system 400, I/O unit 405 may couple flame detector 401 to a myriad of devices in accordance with objectives of the present invention. For example, and in no way limiting the scope of the present invention: a simple set of LEDS 407 that may serve as visual indicators of a status; an audio device such as a speaker 408 for sounding an alarm; an actuator 409 for activating an auxiliary system such as a fire suppression system; a local UI such as a simple display 410 for providing an output; or a communication interface such as a transmitter 411 or transceiver for communicating an output to an external device. For example, and without limiting the scope of the present invention, a client device such as mobile device 412 may be utilized to communicate directly with flame sensor 401 via transmitter that sends a user detectable signal. Moreover, information pertaining to the flame detector may be provided to a gateway 413 in communication with a local network 414. As may be appreciate by a person of ordinary skill in the art, a computer or server 415 may host a database 416 in which logs or records of information provided by flame detector 401 may be stored and retrieved remotely, for example via a second client device or laptop 417.

A number of possible configurations are envisioned by the present invention, such as user detectable signals that are generated by a user interface UI 410 (typically comprising a display and input means such as buttons to select from output displays of CPU 402, where text and/or graphical notice of an alarm condition may be shown on the local display), viewable lights or LEDS 407 (for each type of user detectable signals, different light or different colored light is provided at the flame detector housing or nearby so its activation may be viewable to a local user), audible alarms may be sounded via speaker 408 (for each type of user detectable signals, as different sounds may be optionally provided from flame detector housing itself or a remote speaker in communication with flame detector 401 so its activation is audible to a user), automated action mechanisms such as an actuator 409 (for each type of user detectable signals, different mechanisms are optionally provided at from flame detector housing or nearby, where most notably flame suppression gas or water sprays directed at an open flame are turned on upon detection of flames by the infrared and/or UV optical detectors), and remote correspondent or transmitter 411, where identical user detectable signals that are notices are activated at a remote computer or mobile communication device.

Accordingly, in exemplary embodiments, a method performed by a microprocessor or CPU 402 disposed on sensing circuitry 401*c* of flame detector 401, may comprise the steps of: (i) receiving, from one or more sensors 406 in optical communication with a parabolic or conical reflective surface (within enclosure 401*a*) coupled to a sealed housing 401*b* securing the sensing circuitry 401*c*, a first set of signals associated with direct emission signals received by the one or more sensors 406 directly from an emission signal source; (ii) receiving, from the one or more sensors 406, a second set of signals associated with reflected emission signals from the emission signal source that have been reflected by the parabolic or conical reflective surface (within enclosure 401*a*) to the one or more sensors 406; and (iii) generating a user detectable signal in response to determining that a flame is present in a field of view outside of a shield window incorporated on a top side of the sealed housing 401*b*.

In some exemplary embodiments, the method performed by the microprocessor or CPU 402 disposed on sensing circuitry 401*c* of flame detector 401, may further include executing a location algorithm to determine an approximate physical location of the flame.

In some exemplary embodiments, the method performed by the microprocessor or CPU 402 disposed on sensing circuitry 401*c* of flame detector 401, may further include: establishing communication with a client device 412 or 417; and providing the client device 412 or 417 with an output associated with the user detectable signal.

In some exemplary embodiments, the method performed by the microprocessor or CPU 402 disposed on sensing circuitry 401*c* of flame detector 401, may further include providing an output associated with the user detectable signal, including one or more selected from the group consisting of: lighting a viewable light; sounding an audible alarm; and displaying an alarm notification on a local or remote user interface.

Of course, although the method described above is exemplarily disclosed with a series of steps in one particular sequence, the method may include fewer or more steps in alternative sequences without deviating from the scope of the present invention.

Now with reference to FIG. 5, a method implemented by a flame detector system in accordance with exemplary embodiments of the present invention is illustrated. More specifically, FIG. 5 depicts method 500, performed by a flame detector system in accordance with the present invention, for communicating sensing data between a flame detector having the characteristics described above, and a client device in communication with the flame detector within the flame detector system. Although method 500 is exemplarily shown with a series of steps in one particular sequence, method 500 may include fewer or more steps in alternative sequences without deviating from the scope of the present invention.

In step 501, a set of direct emission signals from an emission signal source within a view angle of a reflective surface of the flame detector may be received by a sensing circuitry including one or more optical sensors of the flame detector. In step 502, a set of reflected emission signals from the emission signal source that have been reflected by the reflective surface in optical communication with the one or more optical sensors of the flame detector may be received. That is, the sensors receive a first set of signals directly from the flame source and a second set of signals from the flame source reflected on a reflecting surface that reflects the reflected signals to the sensors. In step 503, a digital signal associated with the direct emission signals and the reflective emission signals may be generated by a microprocessor coupled to the one or more optical sensors, wherein the digital signal may comprise one or more user detectable signals. Optionally generating one or more digital signals associated with the direct and reflected emission signals may include executing an algorithm for computing a location of the source of the emission signals, wherein the algorithm infers from the path of reflection of that portion of all reflected emission signals a remote location of the source of the emission signals, i.e., a physical location of the flames from which the emission signals originated.

In step 504, the flame detector may establish a communication with a client device. This may include a mobile device such as mobile device 412 that may be in proximity to the flame detector, a gateway to a LAN such as gateway 413 that may be within communication range and configured to receive communications from the flame detector, or a remote computer that may connect to the flame detector via the gateway such as computer or client device 417.

In step 505, the flame detector may provide to the client device an output associated with the one or more digital signals, wherein the output includes logs or records of information provided by the flame detector such as an output in a visible screen, by way of a local user interface of the client device, showing an approximate physical location of the flame emitting the emission signals and or any other of the output information described above.

A flame detector with signal collector and focuser has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

What is claimed is:

1. A flame detector, comprising:

a sealed housing with a shield window incorporated on a top side of the sealed housing;

a sensing circuitry disposed within an internal space of the sealed housing, the sensing circuitry including one or more optical sensors directed up toward the shield window; and an enclosure including a slanting flat side wall and a concave reflective surface forming a donut-shaped ring in the interior region of the enclosure, wherein the enclosure increases a signal to noise ratio of emission signals received at the sensing circuitry, the enclosure coupled to the sealed housing arranged about a space outwardly from the shield window and adapted to reflect the emission signals from an emission signal source to the one or more optical sensors, wherein the sensing circuitry is configured to determine if a flame is present in a field of view outside of the shield window.

2. The flame detector of claim 1, wherein the sensing circuitry is further configured to generate a user detectable signal in response to determining that the flame is present in the field of view outside of the shield window.

3. The flame detector of claim 1, wherein a determination by the sensing circuitry of whether the flame is present in the field of view outside of the shield window includes:

receiving, from the one or more optical sensors, a set of signals associated with direct emission signals from the emission signal source; and receiving, from the one or more optical sensors, a set of signals associated with the reflected emission signals from the emission signal source that have been reflected by the reflective surface to the one or more optical sensors.

4. The flame detector of claim 1, wherein the reflective surface comprises a conical reflective surface.

5. The flame detector of claim 1, wherein the reflective surface comprises a parabolic reflective surface.

6. The flame detector of claim 1, wherein the reflective surface is disposed in an interior region of a parabolic or conical enclosure including a first aperture coupled to the shield window, a second aperture opposite to the first aperture, and a side wall connecting the first and second apertures that defines the space outwardly from the shield window of the reflective surface adapted to reflect the emission signals from the emission signal source to the one or more optical sensors.

7. The flame detector of claim 1, wherein the reflective surface is removably coupled to the sealed housing.

8. A flame detector, comprising:

a sealed housing with a shield window incorporated on a top side of the sealed housing;

a sensing circuitry disposed within an internal space of the sealed housing, the sensing circuitry including one or more optical sensors directed up toward the shield window; and an enclosure including a slanting flat side wall and a concave reflective surface forming a donut-shaped ring in the interior region of the enclosure, wherein the enclosure increases a signal to noise ratio of emission signals received at the sensing circuitry, the enclosure coupled to the sealed housing arranged about a space outwardly from the shield window and adapted to reflect the emission signals from an emission signal source to the one or more optical sensors, wherein the sensing circuitry is configured to:

receive, from the one or more optical sensors, a set of signals associated with direct emission signals from the emission signal source;

receive, from the one or more optical sensors, a set of signals associated with the reflected emission signals from the emission signal source that have been reflected by the reflective surface to the one or more optical sensors; and generate a user detectable signal in response to determining that a flame is present in a field of view outside of the shield window.

9. The flame detector of claim 8, wherein the reflective surface is disposed in an interior region of a parabolic or conical enclosure including a first aperture coupled to the shield window, a second aperture opposite to the first aperture, and a side wall connecting the first and second apertures that defines the space outwardly from the shield window.

10. The flame detector of claim 9, wherein the reflective surface comprises a conical reflective surface.

11. The flame detector of claim 9, wherein the reflective surface comprises a parabolic reflective surface.

12. The flame detector of claim 9, wherein the parabolic or conical enclosure is removably coupled to the sealed housing.

13. The flame detector of claim 9, wherein the user detectable signals comprise of one or more selected from the group consisting of:

a viewable light;

an audible alarm; and a display of an alarm notification on a local or remote user interface.

14. The flame detector of claim 9, wherein the sensing circuitry is further configured to execute a location algorithm to determine an approximate physical location of the emission signal source.

15. A method performed by a microprocessor disposed on a sensing circuitry of a flame detector, comprising the steps of:

receiving, from one or more sensors in optical communication with a parabolic or conical reflective surface coupled to a sealed housing securing the sensing circuitry, a first set of signals associated with direct emission signals received by the one or more sensors directly from an emission signal source, wherein an enclosure coupled to the one or more sensors includes a slanting flat side wall and a concave reflective surface forming a donut-shaped ring in the interior region of the enclosure that increases a signal to noise ratio of the first set of signals;

receiving, from the one or more sensors, a second set of signals associated with reflected emission signals from the emission signal source that have been reflected by the parabolic or conical reflective surface to the one or more sensors; and generating a user detectable signal in response to determining that a flame is present in a field of view outside of a shield window incorporated on a top side of the sealed housing.

16. The method of claim 15, further comprising:

executing a location algorithm to determine an approximate physical location of the flame.

17. The method of claim 15, further comprising:

establishing communication with a client device; and providing the client device with an output associated with the user detectable signal.

18. The method of claim 15, further comprising providing an output associated with the user detectable signal, including one or more selected from the group consisting of:

lighting a viewable light;

sounding an audible alarm; and displaying an alarm notification on a local or remote user interface.

* * * * *